US008991827B2

(12) United States Patent
Thomassian

(10) Patent No.: US 8,991,827 B2
(45) Date of Patent: Mar. 31, 2015

(54) BINGO GAME USING EXTRA SYMBOLS

(71) Applicant: Xpertx, Inc., Reno, NV (US)

(72) Inventor: Eric Thomassian, Reno, NV (US)

(73) Assignee: Xpertx, Inc., Reno, NV (US)

( * ) Notice: Subject to any disclaimer, the term of this patent is extended or adjusted under 35 U.S.C. 154(b) by 0 days.

(21) Appl. No.: 13/869,332

(22) Filed: Apr. 24, 2013

(65) Prior Publication Data

US 2013/0285325 A1 Oct. 31, 2013

Related U.S. Application Data

(60) Provisional application No. 61/638,819, filed on Apr. 26, 2012.

(51) Int. Cl.
*A63F 3/06* (2006.01)

(52) U.S. Cl.
CPC ..... *A63F 3/062* (2013.01); *A63F 3/0645* (2013.01)
USPC ..... 273/269; 463/19

(58) Field of Classification Search
CPC ..... A63F 3/0645; A63F 3/062
USPC ..... 273/269; 463/19
See application file for complete search history.

(56) References Cited

U.S. PATENT DOCUMENTS

| | | | | |
|---|---|---|---|---|
| 5,482,289 | A * | 1/1996 | Weingardt | 273/269 |
| 5,560,608 | A * | 10/1996 | Silverschotz | 273/240 |
| 5,647,798 | A * | 7/1997 | Falciglia | 463/19 |
| 5,657,991 | A * | 8/1997 | Camarato | 273/269 |
| 7,614,948 | B2 | 11/2009 | Saffari et al. | |
| 7,666,084 | B2 | 2/2010 | Herrmann et al. | |
| 7,731,581 | B2 | 6/2010 | Chamberlain et al. | |
| 7,874,907 | B2 | 1/2011 | Lozano et al. | |
| 7,951,004 | B2 | 5/2011 | Saffari et al. | |
| 7,959,509 | B2 | 6/2011 | Saffari et al. | |
| 7,997,581 | B2 | 8/2011 | Brennan | |
| 8,070,585 | B2 | 12/2011 | Herrmann et al. | |
| 8,128,478 | B2 | 3/2012 | Meyer | |
| 8,147,325 | B2 | 4/2012 | Kane et al. | |
| 8,192,279 | B2 | 6/2012 | Saffari et al. | |
| 8,197,326 | B2 | 6/2012 | Chamberlain et al. | |
| 2004/0152504 | A1 | 8/2004 | Herrmann et al. | |
| 2004/0152510 | A1 | 8/2004 | Herrmann et al. | |
| 2005/0233798 | A1 | 10/2005 | Van Asdale | |
| 2006/0205468 | A1 | 9/2006 | Saffari et al. | |
| 2009/0291735 | A1 | 11/2009 | Jasper et al. | |
| 2011/0201417 | A1 | 8/2011 | Saffari et al. | |
| 2012/0077562 | A1 | 3/2012 | Herrman et al. | |
| 2012/0165092 | A1 | 6/2012 | Saffari et al. | |

OTHER PUBLICATIONS http://bingo.lifetips.com/faq/122101/0/what-is-a-wild-pattern-bingo-card/index.html.
http://www.trademarkia.com/trademarks-search.aspx?tn=wild+spots+bingo.
http://bingo.lifetips.com/cat/64165/bingo-trends/index.html.

* cited by examiner

*Primary Examiner* — Benjamin Layno
(74) *Attorney, Agent, or Firm* — Ian Burns; ATIP Law

(57) ABSTRACT

In a draw style wagering game, a player may be allocated a player card displaying a plurality of symbols from a symbol set. When a draw is conducted, a determination is made as to whether the drawn symbols on the player card form a winning pattern. If no winning pattern can be made, a winning pattern can be created by supplementing the drawn symbols with one or more wild symbols up to a maximum number. A payout may be awarding for the winning pattern. The payout may be dependent on the number of wild symbols used to create the winning pattern.

8 Claims, 3 Drawing Sheets

20

SAMPLE 5 SYMBOL PATTERN CARD

| | | | | |
|---|---|---|---|---|
| 1 | 16 | 37 | 46 | 62 |
| 5 | 17 | 33 | 48 | 68 |
| 14 | 19 | ☒ | 53 | 69 |
| 11 | 20 | 38 | 60 | 71 |
| 9 | 27 | 44 | 55 | 74 |

21 22 24 23

25 Maximum 2 Wild spots allowed

5 SYMBOL PATTERN PAY SCHEDULE

26

| No. of Wild spots Used to Complete Pattern | Prize |
|---|---|
| 2 | $1 |
| 1 | $15 |
| 0 | $1,000 |

Figure 2

BINGO GAME USING EXTRA SYMBOLS

CROSS REFERENCE TO RELATED APPLICATIONS

This application claims priority to U.S. provisional patent application Ser. No. 61/638,819, filed Apr. 26, 2013 the contents of which are herein incorporated by reference.

FIELD OF THE INVENTION

The present invention relates to wagering games and in particular to draw style wagering games such as Bingo and the like.

BACKGROUND

Draw style games such as Bingo, Keno, etc are conducted by allocating a player a card bearing a number of symbols, typically numbers. The symbols on the player card are a subset of a symbol set. To play the game, a draw is conducted in which a number of symbols are drawn from the symbol set. A player wins when the symbols on the player card match the drawn symbols under certain criteria. One such criteria may be that a certain number of the player symbols are drawn. Another criteria may be that the drawn symbols on the player card form a winning pattern. The draw may continue for a predetermined number of symbols. In a multi-player environment, the draw may continue until there is at least one winner.

Various methods for conducting bingo style games are known and are well established to the point where this style of game can be considered less exciting and attractive to players. What is required is a new draw style game that can be more attractive to gaming patrons.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to attract patrons to play a bingo style game;

provide more possibilities for winning a bingo style game.

These and other advantages may be realized by reference to the remaining portions of the specification, claims, and abstract.

Brief Description of One Embodiment of the Present Invention

In one embodiment, there is provided a method of conducting a bingo game. A player may be allocated a player card displaying a plurality of symbols from a symbol set. When a draw is conducted, a determination is made as to whether the drawn symbols on the player card form a winning pattern. If no winning pattern can be made, a winning pattern can be created by supplementing the drawn symbols with one or more wild symbols up to a maximum number. A payout may be awarding for the winning pattern. The payout may be dependent on the number of wild symbols used to create the winning pattern.

In one embodiment, there is a provided a gaming apparatus comprising at least one processor programmed to receive a wager for a game. In response to receiving the wager, the apparatus may allocate a player card to a player, the player card comprising a plurality of symbols from a symbol set. The at least one processor may conduct a draw of symbols from the symbol set and determine if the player card is to be awarded a payout. The payout determination can be dependent on the pattern of symbols on the player card that match the drawn symbols, supplemented, if required, by one or more wild symbols up to a maximum number of wild symbols.

In one embodiment, the invention provides a gaming apparatus comprising means for receiving a wager; means for generating a player card comprising a plurality of symbols from a symbol set; means for conducting a draw of symbols from the symbol set; means for determining a number of wild symbols required to make the player card a winning player card; and means for determining a payout for the player card based on the determined number of player symbols.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

FIG. 2 substantially shows an embodiment of a player card; and

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

The present invention comprises a bingo-like game that utilizes extra symbols or wild symbols called "Wild spots", in conjunction with "Player Symbols" (see below) to complete a pattern match and to determine winners. The "Wild spot" designation is for reference purposes only and may be changed for marketing or other purposes. The game is played by performing a number of steps described below.

Figure 1:
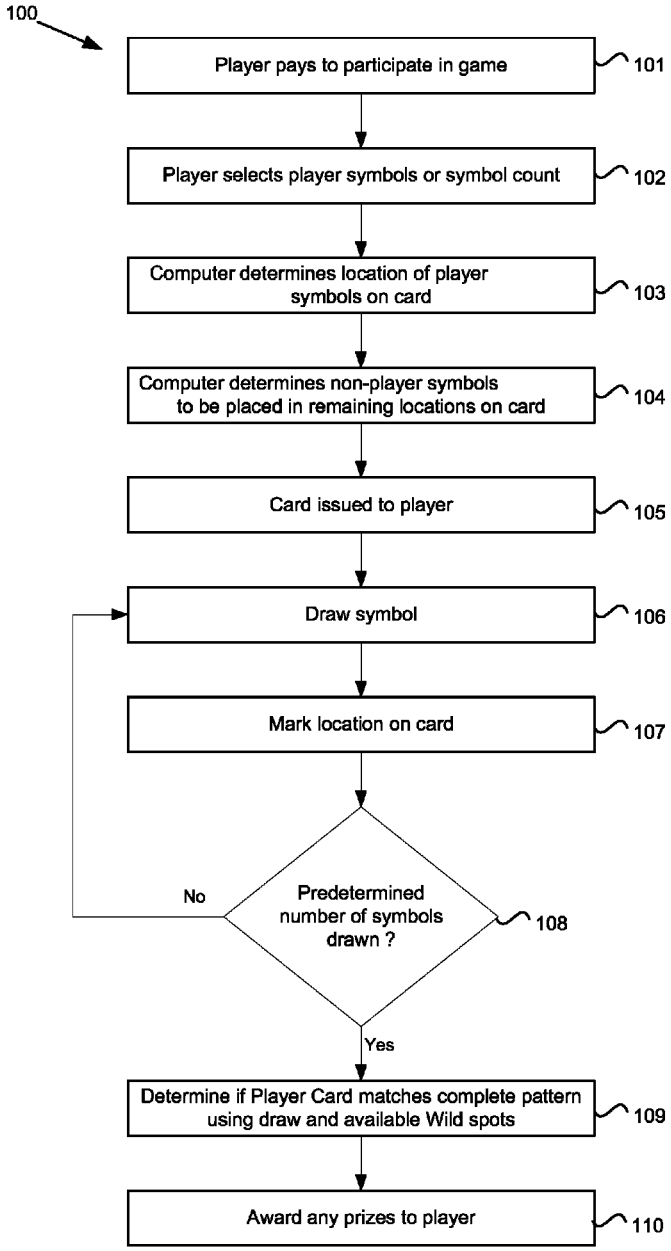
FIG. 1 is substantially a flowchart of a gaming method.

As seen in FIG. 1, a method of playing the game is generally indicated with reference number 100. In step 101, a player first pays to participate in the game. The cost of participating in the game may vary over a wide range and it may be determined by the game operator.

The player may request a wager verbally or present a wager request slip. The wager request may then be scanned by a computer scanner or an attendant may manually enter the player's selections. In another embodiment, the player directly enters the player's selection into a computer using an input device, such as a touch screen or keyboard.

In one embodiment, the player is allowed to select the number of symbols from the symbol set or in an alternative embodiment, the player picks the actual symbols or in a third embodiment he is provided with a previously preprinted paper or electronic card. The symbols may comprise many different kinds of items, such as numbers, letters, geometric shapes, objects, etc. In the example method depicted in FIG. 1, the player selects the symbols (step 102), a computer of the gaming system determines the location of the player symbols on a player card (step 103) and the computer then determines the placement of non-player symbols on the card (step 104).

The card is then issued and presented to the player called the "Player Card" (step 105). The card may be printed on paper or other media and given to the player or the card may be virtually issued to the player on a smart phone, tablet PC, kiosk, computer console or other electronic device featuring an electronic display. A sample Player Card 20 is displayed in FIG. 2.

The number of allowed symbols to play may vary and is determined by the game operator. In the embodiment where the player is allowed to choose the number of symbols, the actual symbols are randomly picked from the total symbol set by the computer software and placed in a pattern containing the number of symbols chosen. The symbols required to win the game, whether chosen by the player or picked randomly by the computer based on the number of symbols requested by the player are called "Player Symbols" and are prominently noted on the Player Card. In the example provided in FIG. 2, the Player Symbols, e.g., symbol 21 having a symbol value of "1", are inversely marked (darkened boxes) but may be noted by circling the symbols, or by other methods of visual designation.

The combination of all the Player Symbols is the "Pattern". The Player Symbols may be arranged in a variety of geometric shapes. Many different possible predetermined patterns may be used, such as one or more horizontal rows, vertical columns, diagonal lines, corners, letters, blackout (all spaces marked) etc. FIG. 2 shows an instance of a Player Card where a five symbol game was chosen. The computer has determined that symbol 1, denoted by reference numeral 21 will be located in row 1, column 1 and that symbol 17 (reference numeral 22) will be located in row 2, column 2, etc. The determination of the symbol and/or the location of said symbol may be predetermined or performed using a random number generator and a selection algorithm. The Player Symbols and by definition the Pattern for the card presented in FIG. 2 consist of the numbers: 1, 17, 33, 48 and 62. The computer also randomly determines the non-player symbols, e.g. symbol 23 having a symbol value of "9", that shall be placed in all remaining locations outside the Pattern on the card and that are not of any direct consequence to the game such as the symbols 11, 38, 69, etc. in FIG. 2. The center location 24 may be designated as "Free" as in traditional Bingo games or in another embodiment of the game, it may also be used as a location for a symbol and possible inclusion in a pattern.

Furthermore, on each card provided to the player will be a designation 25 of the maximum number of Wild spots that can be used to win the prize listed in the prize schedule. In the example indicated in FIG. 2, the maximum number of Wild spots allowed for that Player Card is 2. In another embodiment the number of Wild spots that can be used for each wager type (wager with a given number of symbols) will be published as part of the pay schedule 26.

With reference again to FIG. 1, the computer starts drawing symbols randomly from the symbol set (step 106) using any acceptable internal or external random draw method such as Random Number Generators or balls, one symbol at a time, from a group consisting of all of the possible un-drawn symbols. If the drawn symbol appears on the Player Card, the player may optionally note the event or mark the space as drawn (step 107). For example, if symbol 19 is drawn, the player could note that number 19 has been drawn, and that it resides in row 3, column 2 outside the wagered pattern so does not count to complete the pattern. Conversely, if number 33 is the symbol drawn, because it is placed in row 2 in column 3 inside the designated wager pattern, it can be marked and noted as counting toward the completion of the pattern. If the game system uses virtual cards, the card may be automatically marked.

The computer continues drawing symbols randomly until a predetermined number of symbols have been drawn (determination step 108). The totality of the symbols selected is called the "Draw". The number of symbols to draw is determined by the operator prior to the draw and will usually not change at a given establishment. It will typically be posted and known to all players.

A player wins when the predetermined Pattern on their Player Card is completely matched to the symbols drawn using any combination of symbols drawn and Wild spots available (step 109). Each Wild spot can be used singly to complete the pattern in lieu of a symbol that was not picked in the draw. Wins are determined as per the published pay schedule 26 for the symbol pattern used and with regard to the number of Wild spots used to replace non-drawn player symbols to complete the pattern. For example, if as part of the Draw symbols 19, 20 and 64 had been drawn and were noted by the player as illustrated in FIG. 2, these symbols are outside the wager pattern and are considered non-matches. Number 19 and 20 were shown on the card outside the pattern and number 64 does not show on the card at all, and so is a non-match. Conversely, if the symbols 17, 33, and 62 were part of the Draw and symbols 1 and 48 were NOT part of the draw, then the Player Card depicted in FIG. 2 would only be missing the symbols 1 and 48 to complete the Pattern. As per the information on the Player Card, this card has 2 Wild spots available to complete a pattern. One Wild spot would be used in lieu of Symbol 1 and another in lieu of Symbol 48. This card would be a winner using 2 Wild spots.

At step 110, the player is awarded a prize, if a pattern match is obtained, for the Player Card. In the present invention, the player is paid a greater prize for forming a pattern match using fewer Wild spots to achieve the pattern match. Conversely, the player is awarded a smaller prize for using a greater number of Wild spots to achieve the pattern match, and the player is awarded no prize at all if the pattern match cannot be achieved using a combination of player symbol matches with the maximum number of Wild spots allowed in said pay schedule. In accordance with this aspect of the invention, an example pay schedule (paytable) for a 10 symbol pattern is shown in Table 1:

TABLE 1

| 10 SYMBOL PATTERN PAY SCHEDULE | |
|---|---|
| Number of Wild Spots Used to Complete Pattern | Prize |
| 5 | $ 2 |
| 4 | $ 25 |
| 3 | $ 200 |
| 2 | $ 2000 |
| 1 | $10,000 |
| 0 | $50,000 |

A fixed and published pay schedule is offered to any and all participants playing at a given establishment and does not deviate from player to player. Of course the example pay schedule in "Table 1" is intended as an example only and the prizes awarded and the number of Wild spots offered may be different at the discretion of the operator. As can be seen from this example pay schedule in Table 1, if, for example, at the conclusion of the random Draw, a player has achieved a predetermined pattern match using 7 player symbols and 3 Wild spots, the player is paid $200. If the player had achieved a predetermined pattern match using 10 player symbols and 0 Wild spots, the player would be paid $50,000. If only 4 Player Symbols are matched, the player forfeits the wager because the maximum number of Wild spots allowed with this pay schedule are 5, which in combination with the 4 Player Symbol matches does not complete the 10 symbol Pattern match.

In one embodiment, the maximum number of wild symbols is dependent on the amount wager. For example, for a $1 wager in a 10 symbol pattern game, the maximum number of wild symbols in a 10 symbol game may be 3. For a $2 wager, the maximum number of wild symbols may be 4 and for a $5 wager the maximum number of wild symbols may be 5.

Some of the steps of the present invention may be performed in an order that is different that the order shown and discussed herein and some of the steps may be optional.

Figure 3:
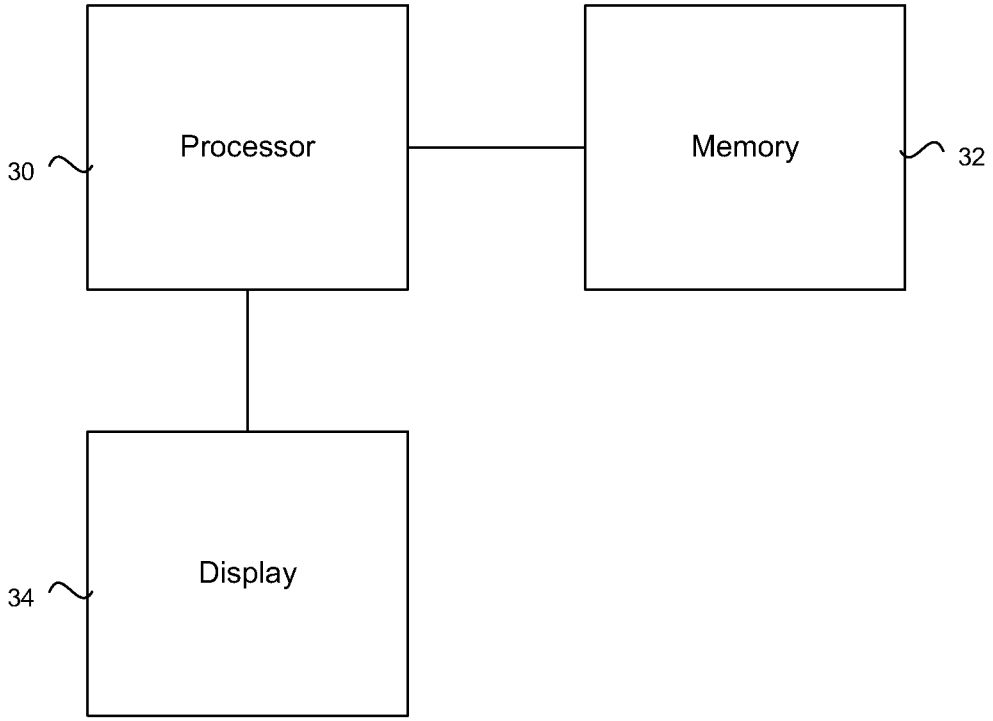
FIG. 3 substantially shows a gaming apparatus for conducting the gaming method.

FIG. 3 is a schematic representation of a gaming apparatus suitable for performing the gaming method herein described. The gaming apparatus may include at least one processor 30 operatively associated with at least one memory 32 and at least one display 34. The processor 30 may be a single processor or may embody a distributed application that executes across multiple processors. For example, a central processor may be responsible for allocating player cards, conducting the draw, while a processor of a gaming machine, such as a gaming console in a casino establishment, or a mobile phone, may be responsible for displaying the player card on the display 34, receiving user input, etc. The memory 32 may store paytable information that is referenced by the processor 30 for determining payouts, etc.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given.

What is claimed is:

1. A gaming apparatus comprising at least one processor programmed to:

(A) receive a wager for a game;

(B) in response to receiving the wager, allocate at least one player card to at least one player, the player card comprising a plurality of distinct symbols from a symbol set;

(C) conduct a draw of symbols from the symbol set;

(D) determine if a pattern of drawn symbols on the player card is a winning pattern;

(E) if the pattern of drawn symbols on the player card is not a winning pattern, then determine if a winning pattern can be created on the player card using the drawn symbols on the player card and one or more wild symbols up to a maximum number of wild symbols;

(F) if a winning pattern can be created on the player card using the one or more wild symbols, determine a payout for the player card.

2. The gaming apparatus of claim 1 comprising at least one memory operatively associated with the at least one processor, the at least one memory storing a paytable that associates a payout for a winning pattern with the number of wild symbols used to create the winning pattern, wherein the at least one processor is configured to determine the payout by reference to the paytable.

3. The gaming apparatus of claim 1 wherein the at least one processor is programmed to generate a display of the player card comprising a display of the maximum number of wild symbols.

4. The gaming apparatus of claim 1 wherein the display is electronic.

5. The gaming apparatus of claim 1 wherein the display is printed.

6. The gaming apparatus of claim 1 wherein the player card comprises player symbols and non-player symbols, wherein a winning pattern comprises a plurality of the player symbols on the player card and wherein the processor is programmed to determine if a winning pattern can be created on the player card using one or more wild symbols by replacing at least one player symbol on the player card that was not a symbol of the drawn set of symbols with at least one wild symbol.

7. A gaming apparatus comprising:

(A) means for receiving a wager;

(B) means for generating a player card comprising a plurality of symbols from a symbol set;

(C) means for conducting a draw of symbols from the symbol set;

(D) means for determining a number of wild symbols required to make the player card a winning player card; and (E) means for determining a payout for the player card based on the determined number of player symbols.

8. The gaming apparatus of claim 7 comprising means for determining that the number of wild symbols required to make the player card a winning player card is less than or equal to a maximum number.

* * * * *